US006776495B2

(12) United States Patent
Nomiyama

(10) Patent No.: US 6,776,495 B2
(45) Date of Patent: Aug. 17, 2004

(54) CHEMILUMINESCENT DEVICE

(75) Inventor: Jun Nomiyama, Koga (JP)

(73) Assignee: Lumica Corporation, Koga (JP)

( * ) Notice: Subject to any disclaimer, the term of this patent is extended or adjusted under 35 U.S.C. 154(b) by 0 days.

(21) Appl. No.: 10/315,951

(22) Filed: Dec. 11, 2002

(65) Prior Publication Data

US 2003/0137826 A1 Jul. 24, 2003

(30) Foreign Application Priority Data

Jan. 23, 2002 (JP) ..... 2002-013659
Feb. 5, 2002 (JP) ..... 2002-028481

(51) Int. Cl.[7] ..... F21K 2/06
(52) U.S. Cl. ..... 362/34; 362/84; 362/231; 362/247
(58) Field of Search ..... 362/34, 84, 230, 362/231, 247, 235; 206/219

(56) References Cited

U.S. PATENT DOCUMENTS 3,665,967 A * 5/1972 Kacknik ..... 138/137
5,325,273 A * 6/1994 Kuo ..... 362/34
5,370,828 A * 12/1994 Ladyjensky ..... 252/700
5,383,100 A * 1/1995 Kikos ..... 362/34
5,508,893 A * 4/1996 Nowak et al. ..... 362/34
5,980,055 A * 11/1999 Palmer et al. ..... 362/34

* cited by examiner

*Primary Examiner*—Alan Cariaso
*Assistant Examiner*—Guiyoung Lee
(74) *Attorney, Agent, or Firm*—Westerman, Hattori, Daniels & Adrian, LLP

(57) ABSTRACT

The chemiluminescent device has a luminous body capable of generating light through a chemiluminescent reaction, and an outer layer for covering the luminous body. The outer layer is made of closed-cell plastic foam having a forming ratio in the range of 3 to 50%, preferably in the range of 20 to 30%. Closed-cell foamed polyethylene having no adverse environmental effect may be advantageously used as the closed-cell plastic foam. The chemiluminescent device having the outer layer made of closed-cell plastic foam provides increased luminous area, unsusceptibility to ambient temperature, and enhanced softness and shock-absorbability to achieve satisfactory luminescent effect, safety and reliability. The outer layer may have an outer surface formed with an irregularity to provide further enhanced luminescent effect.

18 Claims, 3 Drawing Sheets

CHEMILUMINESCENT DEVICE

FIELD OF THE INVENTION

The present invention relates to a chemiluminescent device used as toys, emergency lights, fishing goods or the like. In particular, the present invention relates to a chemiluminescent device including a luminous body capable of generating light through a chemiluminescent reaction.

BACKGROUND OF THE INVENTION

There has heretofore been known a chemiluminescent device composed of a luminous body. The luminous body includes a light-permeable, flexible container made of polyethylene, polypropylene or the like, a breakable capsule made of glass or the like and contained in the container, and two chemical components for making a chemiluminescent mixture, which are enclosed separately in the capsule and a space between the container and the capsule. In use, the capsule is broken, for example, by bending the container, to mix the chemical components. The resulting chemiluminescent mixture generates light through a chemiluminescent reaction, and the generated light will be emitted through the light-permeable container.

In the luminous body, it is desirable to enlarge a luminous area or the outer surface area of the container to achieve enhanced luminous effect. However, larger outer surface area of the container involves increased amount of the chemical components, which undesirably increases the weight and cost of the luminous body. This imposes a restriction on the luminous area. For example, a cylindrical luminous body realistically has a diameter of Φ20 mm at most.

In addition, the container is made of a material having a relatively low softness or shock-absorbability. Therefore, the capsule is frequently broken during transportation. Also, it is dangerous to throw at a person the chemiluminescent device or hit a person with the device, because the insufficient softness or shock-absorbability can inflict an injury, and the container can be damaged to cause leakage of the chemical component. Further, for assuring light-permeability and flexibility, the container has a thin thickness of 0.5 mm to 1.5 mm, and thereby the chemical components contained in the container are subject to ambient temperature. For example, when the luminous body is used at an ambient temperature of 0° C. or less, luminance from the chemiluminescent mixture will be deteriorated in the shortest time. Furthermore, during commercial distribution, the capsule is always exposed to risk of unintended breakage.

Thus, in view of highly efficient, reliable, safety-conscious products, there is the need for providing a chemiluminescent device having enhanced luminescent effect, safety and reliability.

SUMMARY OF THE INVENTION

In order to solve the above problems, it is therefore an object of the present invention to provide an improved chemiluminescent device capable of providing increased luminous area to achieve satisfactory luminescent effect while fulfilling fundamental requirements such as weight and cost for the chemiluminescent device.

It is another object of the present invention to provide an improved chemiluminescent device which is not susceptibile to ambient temperature.

It is another object of the present invention to provide an improved chemiluminescent device with enhanced softness for safety and easiness to break the capsule.

It is another object of the present invention to provide an improved chemiluminescent device with reliability and shock-absorbability such that the capsule is not broken by a shock during transportation.

It is another object of the present invention to provide an improved chemiluminescent device capable of providing an additional practical or enjoyable effect such as buoyancy and single-color or multi-color luminescence.

In order to achieve the above objects, according to a first aspect of the present invention, there is provided a chemiluminescent device including a luminous body capable of generating light through a chemiluminescent reaction, and an outer layer for covering the luminous body. The luminous body includes a light-permeable, flexible container, a breakable capsule contained in the container with leaving a space therebetween, and two or more chemical components for making a chemiluminescent mixture, which are enclosed separately in said capsule and said space. Further, the outer layer is made of closed-cell plastic foam. In this device, the light generated by the luminous body is diffusely reflected through the outer layer and then emitted out of the outer layer.

In the first aspect of the present invention, the luminous body is cover by the outer layer made of closed-cell plastic foam. The closed-cell plastic foam is a light-weight material and is practicable in acceptable cost. Further, an adequate light-permeability can be obtained by arranging the forming ratio and the thickness of the closed-cell plastic foam, to allow the light generated by the luminous body to be spread over the outer layer by virtue of the diffuse reflection in the outer layer and be emitted from the entire outer surface of the outer layer.

Thus, larger luminous area can be achieved by covering the luminous body with the outer layer made of closed-cell plastic foam while fulfilling the fundamental requirements for the chemiluminescent device.

In addition, the closed-cell plastic foam has excellent softness and shock-absorbability. This allows the luminous body to be covered by the outer layer having a soft outer surface, so as to achieve increased safety. For example, even if the chemiluminescent device is strongly hit against the human body, accidental injuries will be effectively avoided. Further, the shock-absorbability can prevent unintended chemiluminescence due to the breakage of the container otherwise caused by impact, such as dropping shock, applied to the chemiluminescent device during commercial distribution.

The closed-cell plastic foam can further provide excellent heat-insulation performance to allow the chemiluminescent mixture to be unsusceptible to ambient temperature and be maintained at adequate temperature even if it is used in cold districts. This makes it possible to assure stable luminescent effect for a desired time-period. The closed-cell plastic foam further provides moisture-proof. Thus, in combination with the heat-insulation performance, the chemiluminescent device can be storied without degradation in chemiluminescence even under adverse conditions. Furthermore, the closed-cell plastic foam provides enhanced buoyancy effective upon the application to a marine emergency-light.

The closed-cell plastic foam includes a styrene-based foam, urethane-base form, vinyl chloride-based form, vinyl acetate-added polyethylene-based form, olefin-based form. Among these materials, the polyethylene-based form has various advantages such as excellent chemical stability with respect to the chemical components or the chemiluminescent mixture, excellent shock-absorbability, innocuity and safety to the human body, and disposability without harmful effect.

The forming ratio of the closed-cell plastic foam may be selected in the range of 3 to 50%, preferably in the range of 20 to 30%. Higher forming ratio provides enhanced light-permeability of the closed-cell plastic foam. If the forming ratio is reduced down to less than 3%, a sufficient light-permeability cannot be obtained. If the forming ratio is increased to greater than 50%, the closed-cell plastic foam increases in brittleness with decreased resilience, resulting in deteriorated workability. When the forming ratio is arranged in the range of 20 to 30%, the closed-cell plastic foam or the outer layer can have a thick thickness, for example, substantially equal to the diameter of a cylindrical luminous body, to obtain adequate shock-absorbability with sufficient light-permeability. In this case, the luminous body will have an apparent diameter (the diameter of the outer layer) three times greater than its actual diameter. The thickness should be determined by weighing the advantage of shock-absorbability and light-permeability, because the light-permeability is reduced as increasing the thickness.

In the first aspect of the present invention, the outer layer may have an outer surface formed with an irregularity. As compared with a flat or smooth outer surface of the outer layer, the irregularity allows the outer layer to have further increased outer surface area or luminous area. The irregularity or difference in the thickness of the outer layer can create light and dark portions along the boarder of the irregularity on the outer surface of the outer layer to provide enhanced ornamental effect.

When the outer layer has a cylindrical tubular shape, the irregularity may be formed by providing a spiral groove in the outer surface of the outer layer.

In the cylindrical outer layer, the luminous body may also have a cylindrical tubular shape, and the cylindrical luminous body may be substantially concentrically disposed in the outer layer.

Further, the chemiluminescent device may include a plurality of the luminous bodies. In this case, the chemical components in each of the luminous bodies are arranged to generate a different color light.

According to a second aspect of the present invention, there is provided a chemiluminescent device including an outer layer made of closed-cell plastic foam and provided with an interior space therein, a light reflector disposed in the interior space to divide the interior space into two or more separate spaces, and two or more luminous bodies each capable of generating a different color light through a chemiluminescent reaction. Each of the luminous bodies includes a light-permeable, flexible container, a breakable capsule contained in the container with leaving a space therebetween, and two or more chemical components for making a chemiluminescent mixture, which are enclosed separately in the capsule and the space. The luminous bodies are disposed in the separate spaces, respectively.

In the second aspect of the present invention, a multi-color luminescence can be obtained in addition to the effects according to the first aspect of the present invention. Particularly, when the outer layer is formed in a cylindrical tubular shape, the light reflector may include two or more light-reflector members having an integral common end along the longitudinal axis of the outer layer. The light-reflector members extends separately in the radial direction of the outer layer from the common end to the inner surface of the outer layer defining the interior space, so as to provide the separate spaces. In this case, a multi-color luminescence along the longitudinal direction of the outer layer can be obtained.

Further, the outer layer may have an outer surface formed with an irregularity such as groove to provide enhanced luminous effect as with the first aspect of the present invention.

Other features and advantages of the present invention will be apparent from the accompanying drawings and from the detailed description.

DESCRIPTION OF THE PREFERRED EMBODIMENT

With reference to the drawings, specific embodiments of the present invention will now be described.

[First Embodiment]

Figure 1:
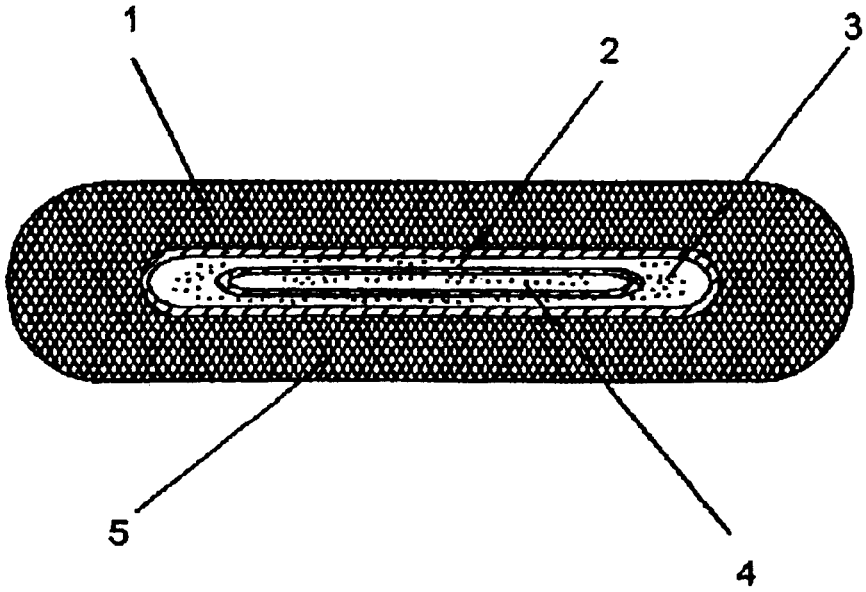
FIG. 1 is a partial longitudinal sectional view of a chemiluminescent device according to a first embodiment of the present invention.

In FIG. 1, a chemiluminescent device according to the first embodiment includes a luminous body 1 capable of generating light through a chemiluminescent reaction. The luminous body includes a light-permeable, flexible container 1, a breakable capsule 2 contained in the container 1 with leaving a space therebetween, and two chemical components 3, 4 for making a chemiluminescent mixture. The chemical components 3, 4 are enclosed in the capsule 2 and the space, respectively. The chemiluminescent device further includes an outer layer 5 covering the luminous body 1. The outer layer is made of closed-cell plastic foam.

For forming the outer layer 5, a closed-cell foamed polyethylene pipe is first formed at a forming ratio of 30% to have an inner diameter of Φ 11 mm and an outer diameter of Φ 25 mm. Then, the pipe is cut to have a length of 280 mm. The luminous body 1 is formed is a cylindrical shape having an outer diameter of Φ 11.5 mm and a length of 250 mm. The luminous body 1 is then inserted into the pipe hole of the outer layer 5 to position it substantially concentrically in the pipe. A cylindrical plug of the same material as that of the closed-cell foamed polyethylene pipe and of outer diameter Φ 12 mm is inserted into each opening on both ends of the pipe. The outer layer 5 can be prepared in this way. However, in order to enhance its product quality, the both ends of the outer layer is further processed to provide a round shape therein. This roundness can be formed by pressing the both ends to a dome-shaped dent of a heating device. Further, an adhesive may be applied in the plug insertion operation to prevent the plugs from coming off.

In use, the luminous body 1 is bent by bending the outer layer 5. Thus, the capsule is broken to mix the chemical components. The resulting chemiluminescent mixture generates light through a chemiluminescent reaction. The generated light evenly reaches the entire outer surface of the outer layer by virtue of diffuse reflection in the outer layer 5, and emitted out of the outer layer 5. While this embodiment has employed the processing for providing the roundness to the both edges of the outer layer, this processing may be omitted. The shape of the outer layer 5 is not limited to the cylindrical tubular shape, but any other suitable shape may be selected. For example, the outer layer may be formed as a pair of flat-plate-shaped outer layers, and the luminous body may be sandwiched by the flat-plate-shaped outer layers. Further, a plurality of the luminous bodies each having chemical components arranged to generate a different color light may be sandwiched by the flat-plate-shaped outer layers. Furthermore, a suitable ornamental pattern or seal may be printed or attached on the outer surface of the outer layer 5.

In this embodiment, the outer layer is made of closed-cell foamed polyethylene. The closed-cell foamed polyethylene is nonhazardous to the human body. Thus, even if an infant takes a lap of the outer layer 5, the chemiluminescent device or outer layer 5 does not cause any harm. The closed-cell structure can prevent leakage of the chemical components otherwise caused by breakage of the container 1.

[Second Embodiment]

Figure 2:
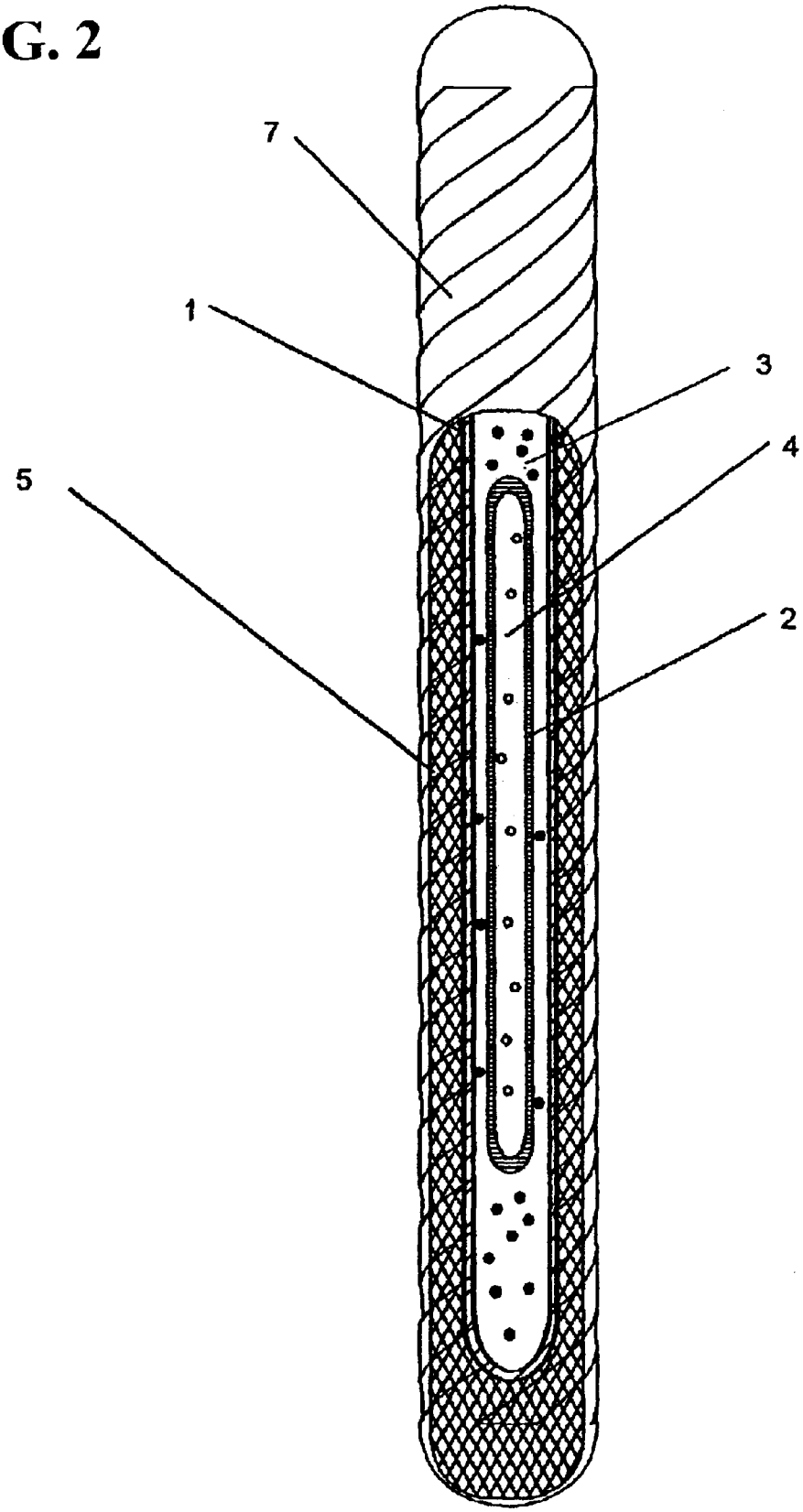
FIG. 2 is a partial longitudinal sectional view of a chemiluminescent device according to a second embodiment of the present invention.

In FIG. 2, a chemiluminescent device according to the second embodiment includes a luminous body 1 capable of generating light through a chemiluminescent reaction. The luminous body includes a light-permeable, flexible container 1', a breakable capsule 2 contained in the container 1' with leaving a space therebetween, and two chemical components 3, 4 for making a chemiluminescent mixture. The chemical components 3, 4 are enclosed in the capsule 2 and the space, respectively. The chemiluminescent device further includes an outer layer 5 covering the luminous body 1. The outer layer is made of closed-cell plastic foam. The outer surface of the outer layer 5 is formed with a spiral groove 7 to provide an irregularity therein.

For forming the outer layer 5, a closed-cell foamed polyethylene pipe is first formed at a forming ratio of 30% to have an inner diameter of Φ 11 mm and an outer diameter of Φ 25 mm. Then, the spiral groove 7 is formed in the outer surface of the pipe, and the pipe is cut to have a length of 280 mm. The spiral groove 7 may be formed after the cutting of the pipe. The luminous body 1 is formed is a cylindrical shape having an outer diameter of Φ 11.5 mm and a length of 250 mm. The luminous body 1 is then inserted into the pipe hole of the inner diameter Φ 11 mm of the outer layer 5 to position it substantially concentrically in the pipe. A cylindrical plug of the same material as that of the closed-cell foamed polyethylene pipe and of outer diameter Φ 12 mm is inserted into each opening on both ends of the pipe. The outer layer 5 can be prepared in this way. However, in order to enhance its product quality, the both ends of the outer layer is further processed to provide a round shape therein. This roundness can be formed by pressing the both ends to a dome-shaped dent of a heating device. Further, an adhesive may be applied in the plug insertion operation to prevent the plugs from coming off.

In use, the luminous body 1 is bent by bending the outer layer 5. Thus, the capsule is broken to mix the chemical components. The resulting chemiluminescent mixture generates light through a chemiluminescent reaction. The generated light evenly reaches the entire outer surface of the outer layer by virtue of diffuse reflection in the outer layer 5, and emitted out of the outer layer 5. At this moment, the border of the groove 7 clearly emerges on the outer surface on the outer layer 5, and light and dark portions are created by the difference in the thickness of the outer layer 5. While this embodiment has employed the processing for providing the roundness to the both edges of the outer layer, this processing may be omitted. Further, the irregularity is not limited to the spiral groove 7, but any other suitable shape may be selected. The shape of the outer layer 5 is not limited to the cylindrical tubular shape, but any other suitable shape may be selected. For example, the outer layer may be formed as a pair of flat-plate-shaped outer layers, and the luminous body may be sandwiched by the flat-plate-shaped outer layers. Further, a plurality of the luminous bodies each having chemical components arranged to generate a different color light may be sandwiched by the flat-plate-shaped outer layers. Furthermore, a suitable ornamental pattern or seal may be printed or attached on the outer surface of the outer layer 5.

In this embodiment, the outer layer is made of closed-cell foamed polyethylene. The closed-cell foamed polyethylene is nonhazardous to the human body. Thus, even if an infant takes a lap of the outer layer 5, the chemiluminescent device or outer layer 5 does not cause any harm. The closed-cell structure can prevent leakage of the chemical components otherwise caused by breakage of the container 1'.

[Third Embodiment]

Figure 3:
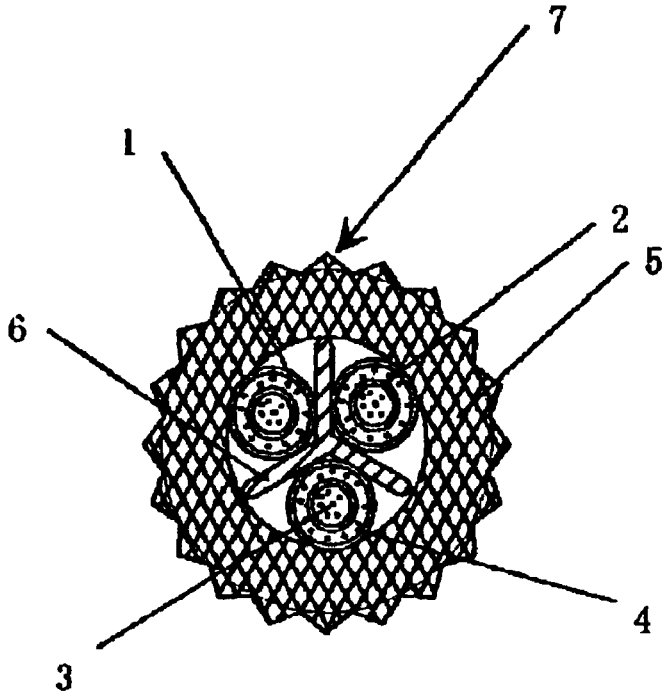
FIG. 3 is a cross sectional view of a chemiluminescent device according to a third embodiment of the present invention.

As shown in FIG. 3, a chemiluminescent device according to the third embodiment includes an outer layer 5 made of closed-cell plastic foam and provided with an interior space therein, a light reflector 6 disposed in the interior space to divide the interior space into three separate spaces, and three luminous bodies 1 disposed in the separate spaces, respectively. The structure of the luminous body 1 is the same as that in the second embodiment.

The light reflector 6 includes three light-reflector members having an integral common end along the longitudinal axis of the outer layer 5. The light-reflector members extends separately in the radial direction of the outer layer 5 from the common end to the inner surface of the outer layer 5 defining the interior space, so as to provide the three separate spaces. The outer layer 5 has an outer surface formed with an irregularity 7

For forming the outer layer 5, a closed-cell foamed polyethylene pipe is formed in the same way as that in the second embodiment. The while-colored light reflector 6 having the Y-shaped cross-section is inserted into the pipe to position it substantially concentrically in the pipe. The three luminous body 1 capable of generating blue, red and green colors, respectively, are inserted separately into the three separate spaces. Both ends of the closed-cell foamed polyethylene pipe is sealed in the same way as that in the second embodiment. When the chemiluminescent device is operated to generate lights, the generated lights are reflected by the corresponding light-reflector members, and emitted out of the outer layer 5 without interference. Thus, each color light can be clearly viewed. While this embodiment has employed the white-colored light reflector 6, any other suitable light reflector such as a mirror-finished surface may be used.

The invention has now been explained with reference to specific embodiments. Other embodiments will be apparent to those of ordinary skill in the art. Therefore, it is not intended that the invention be limited, except as indicated by the appended claims, which form a part of this invention description.

What is claimed is:

1. A chemiluminescent device comprising:

a luminous body capable of generating light through a chemiluminescent reaction, said luminous body including a light-permeable, flexible container, a breakable capsule contained in said container with leaving a space therebetween, and two or more chemical components for making a chemiluminescent mixture, said chemical components being enclosed separately in said capsule and said space; and an outer layer for covering paid luminous body, said outer layer being made of closed-cell plastic foam, wherein the light generated by said luminous body is diffusely reflected through said outer layer and then emitted out of said outer layer.

2. The chemiluminescent device as defined in claim 1, wherein said closed-cell plastic foam is closed-cell foamed polyethylene.

3. The chemiluminescent device as defined in claim 1, wherein said outer layer has a cylindrical tubular shape.

4. The chemiluminescent device as defined in claim 3, wherein said luminous body has a cylindrical tubular shape, said luminous body being substantially concentrically disposed in said outer layer.

5. The chemiluminescent device as defined in claim 3, wherein said outer layer has an outer surface formed with a spiral groove.

6. The chemiluminescent device as defined in claim 1, wherein said outer layer has a flat plate shape.

7. The chemiluminescent device as defined in claim 1, which includes a plurality of said luminous bodies, wherein said chemical components in each of said luminous bodies are arranged to generate a different color light.

8. The chemiluminescent device as defined in claim 1, wherein said outer layer has an outer surface formed with an irregularity.

9. The chemiluminescent device as defined in claim 1, which includes a pattern printed on an outer surface of said outer layer or a seal attached to an outer surface of the outer layer.

10. A chemiluminescent device comprising:

a luminous body capable of generating light through a chemiluminescent reaction, said luminous body including a light-permeable, flexible container, a breakable capsule contained in said container with leaving a space therebetween, and two or more chemical components for making a chemiluminescent mixture, said chemical components being enclosed separately in said capsule and said space; and an outer layer for covering said luminous body, said outer layer being made of closed-cell plastic foam, wherein the light generated by said luminous body is diffusely reflected through said outer layer and then emitted out of said outer layer, wherein said closed-cell plastic foam has a forming ratio in the range of 3 to 50%.

11. A chemiluminescent device comprising:

a luminous body capable of generating light through a chemiluminescent reaction, said luminous body including a light-permeable, flexible container, a breakable capsule contained in said container with leaving a space therebetween, and two or more chemical components for making a chemiluminescent mixture, said chemical components being enclosed separately in said capsule and said space; and an outer layer for covering said luminous body, said outer layer being made of closed-cell plastic foam, wherein the light generated by said luminous body is diffusely reflected through said outer layer and then emitted out of said outer layer, wherein said closed-cell plastic foam has a forming ratio in the range of 20 to 30%.

12. A chemiluminescent device comprising:

an outer layer made of closed-cell plastic foam, said outer layer having an interior space therein;

a light reflector disposed in said interior space to divide said interior space into two or more separate spaces; and two or more luminous bodies each capable of generating a different color light through a chemiluminescent reaction, each of said luminous bodies including a light-permeable, flexible container, a breakable capsule contained in said container with leaving a space therebetween, and two or more chemical components for making a chemiluminescent mixture, said chemical components being enclosed separately in said capsule and said space, said luminous bodies being disposed in said separate spaces, respectively.

13. The chemiluminescent device as defined in claim 12, wherein said closed-cell plastic foam is closed-cell foamed polyethylene.

14. The chemiluminescent device as defined in claim 12, wherein said outer layer has a cylindrical tubular shape.

15. The chemiluminescent device as defined in claim 14, wherein said light reflector includes two or more light-reflector members having an integral common end along the longitudinal axis of said outer layer, said light-reflector members extending separately in the radial direction of said outer layer from said common end to the inner surface of said outer layer defining said interior space, so as to provide said separate spaces.

16. The chemiluminescent device as defined in claim 14, wherein said outer layer has an outer surface formed with a spiral groove.

17. The chemiluminescent device as defined in claim 12, wherein said outer layer has an outer surface formed with an irregularity.

18. The chemiluminescent device as defined in claim 12, which includes a pattern printed on an outer surface of the outer layer or a seal attached to an outer surface of the outer layer.

* * * * *